US006441355B2

(12) United States Patent
Thorneywork

(10) Patent No.: US 6,441,355 B2
(45) Date of Patent: Aug. 27, 2002

(54) MICROWAVE HEATING USING INDEPENDENTLY CONTROLLABLE INTERNAL AND EXTERNAL ANTENNAE

(75) Inventor: Nigel Thorneywork, Guildford (GB)

(73) Assignee: Merrychef Limited, Hampshire (GB)

( * ) Notice: Subject to any disclaimer, the term of this patent is extended or adjusted under 35 U.S.C. 154(b) by 0 days.

(21) Appl. No.: 09/813,239

(22) Filed: Mar. 20, 2001

(30) Foreign Application Priority Data

Mar. 23, 2000 (GB) ..... 0007033

(51) Int. Cl.[7] ..... H05B 6/72

(52) U.S. Cl. ..... 219/748; 219/697; 219/746; 219/717

(58) Field of Search ..... 219/748, 746, 219/750, 745, 761, 695, 696, 697, 681, 685, 717

(56) References Cited

U.S. PATENT DOCUMENTS

| | | | | | |
|---|---|---|---|---|---|
| 2,909,635 | A | * | 10/1959 | Haagensen | 219/746 |
| 3,493,708 | A | * | 2/1970 | Johnson | 219/746 |
| 3,867,607 | A | * | 2/1975 | Ohtani | 219/748 |
| 4,460,814 | A | | 7/1984 | Diesch et al. | 219/10.55 F |
| 4,803,324 | A | * | 2/1989 | Fujii et al. | 219/681 |
| 4,937,418 | A | * | 6/1990 | Boulard | 219/748 |
| 5,451,751 | A | | 9/1995 | Takimoto et al. | 219/746 |
| 5,512,736 | A | | 4/1996 | Kang et al. | 219/750 |

FOREIGN PATENT DOCUMENTS

| | | | | |
|---|---|---|---|---|
| GB | 1470408 | | 4/1977 | |
| GB | 2284133 | | 5/1995 | |
| GB | 2344501 | | 7/2000 | |
| JP | 1-194288 | * | 8/1989 | 219/749 |
| SU | 1239899 | * | 6/1986 | 219/748 |

OTHER PUBLICATIONS

Great Britain Search Report for Application No. GB0007033.4 dated Jul. 25, 2000.

* cited by examiner

*Primary Examiner*—Philip H. Leung
(74) *Attorney, Agent, or Firm*—Ohlandt, Greeley, Ruggiero & Perle, LLP

(57) ABSTRACT

A microwave heating apparatus including a cavity for heating food, a first antenna, which projects into the cavity and is arranged to pass into or through the food in order to irradiate the food internally, and a second antenna arranged to supply microwave radiation into the cavity in order to irradiate the food externally. Microwave energy is supplied to the first and second antennae in such a way that the user can independently control the levels of microwave energy irradiated by the first and second antennae.

13 Claims, 7 Drawing Sheets

LAYERED FOOD PRODUCT

MICROWAVE HEATING USING INDEPENDENTLY CONTROLLABLE INTERNAL AND EXTERNAL ANTENNAE

This application claims priority to Great Britain Patent Application No. 0007033.4, filed Mar. 23, 2000.

The invention relates to microwave heating apparatuses, and methods of heating articles using such apparatuses.

BACKGROUND OF THE INVENTION

When an object is defrosted in a conventional microwave oven, the initial microwave heating effect causes thawing of ice a small distance into the item to be defrosted, producing regions of free water molecules. Because the absorption of microwave energy is much higher in water than in ice, this causes localised heating. In extreme cases it is possible to fully cook the product where the ice has initially melted, while leaving the remaining ice frozen. In the case of a food product which must be stored frozen, and served hot to a customer, for example a burger, this can lead to the situation where the customer is presented with a food product which is apparently correctly cooked and heated, but where certain areas of the product have not attained the legally required temperature before serving. FIG. 1 demonstrates such a situation.

The conventional methods of attempting to overcome this problem come in two forms: introducing a time delay into the thawing process, or shaping the product to maximise the surface area and thus the absorption of microwave energy.

The main benefit quoted for microwave heating is the increase in speed over conventional heating methods. If the time delay method is used to overcome the problem mentioned above, time is allowed during the heating process for thermal conduction to transfer some of the heat from the thawed regions to those which are still frozen; i.e. thawing by conduction as in any conventional method. The delay which is introduced into the heating process is usually performed by operating the magnetrons supplying the microwaves at a reduced duty cycle, i.e. pulsing the magnetrons on and off. A typical ratio of "on" to "off" time is eight seconds "on" followed by twelve seconds "off", which gives an effective reduction to only 40% of the available microwave power, and thus increases the time required to defrost the product by a factor of approximately 2½ times. Particularly in commercial "fast food" applications, this time delay is unacceptable.

In a domestic situation, much use is made of ring shaped cooking containers, the large diameter hollow centre allowing the microwaves to penetrate the product from two sides. This toroidal shape does indeed minimise the problems of ice formation, but at the cost of ease of putting the product into the cooking container. This also has the effect that the product is bulky to store whilst frozen.

One process which has heretofore been considered largely unsuitable for microwave heating is that of "tempering" foodstuffs, i.e. raising the temperature of the product from "deep frozen" (usually considered to be −18° C.) to a "softer" frozen temperature of about −4° C. A particular example of this is the tempering of blocks of meat products to allow mechanical operations, such as slicing to produce evenly thin slices of meats for use in ethnic food preparation. This process usually highlights all of the inadequacies of conventional microwave heating, as the localised melting mentioned above proves disastrous in such a case. Once thawed or tempered, the food product may also then require raising in temperature to a serving condition, possibly also with the addition of extra heating by a conventional means for cosmetic "browning" purposes, without further intervention from the operator of the microwave apparatus.

These problems are alleviated by ovens described in the applicant's earlier British Patent Application No. 9915368.6, filed Jul. 2, 1999, which describes the use of separate internal and external antennae for irradiating food both internally and externally.

British Patent No. 1,470,408 describes a microwave oven in which food is heated internally by a rod which passes through the food, and externally by a plate member, both of which are connected to a single magnetron. However, this may result in the food cooking too quickly from the inside relative to the outside, or vice versa, particularly when different sizes, shapes and types of food are cooked in the oven.

It should be understood that "food" in the present specification includes any type of food or drink. Furthermore, "antenna" in this specification includes any article or part of an article from which radiation is emitted, and includes for example part of a magnetron from which microwave radiation is emitted.

SUMMARY OF THE INVENTION

According to the invention there is provided a microwave heating apparatus and assembly, and a method of heating food, as set out in the accompanying claims.

BRIEF DESCRIPTION OF THE DRAWINGS

Some preferred embodiments of the invention will now be described, by way of example only, with reference to the accompanying drawings, in which.

DETAILED DESCRIPTION

Figure 1:
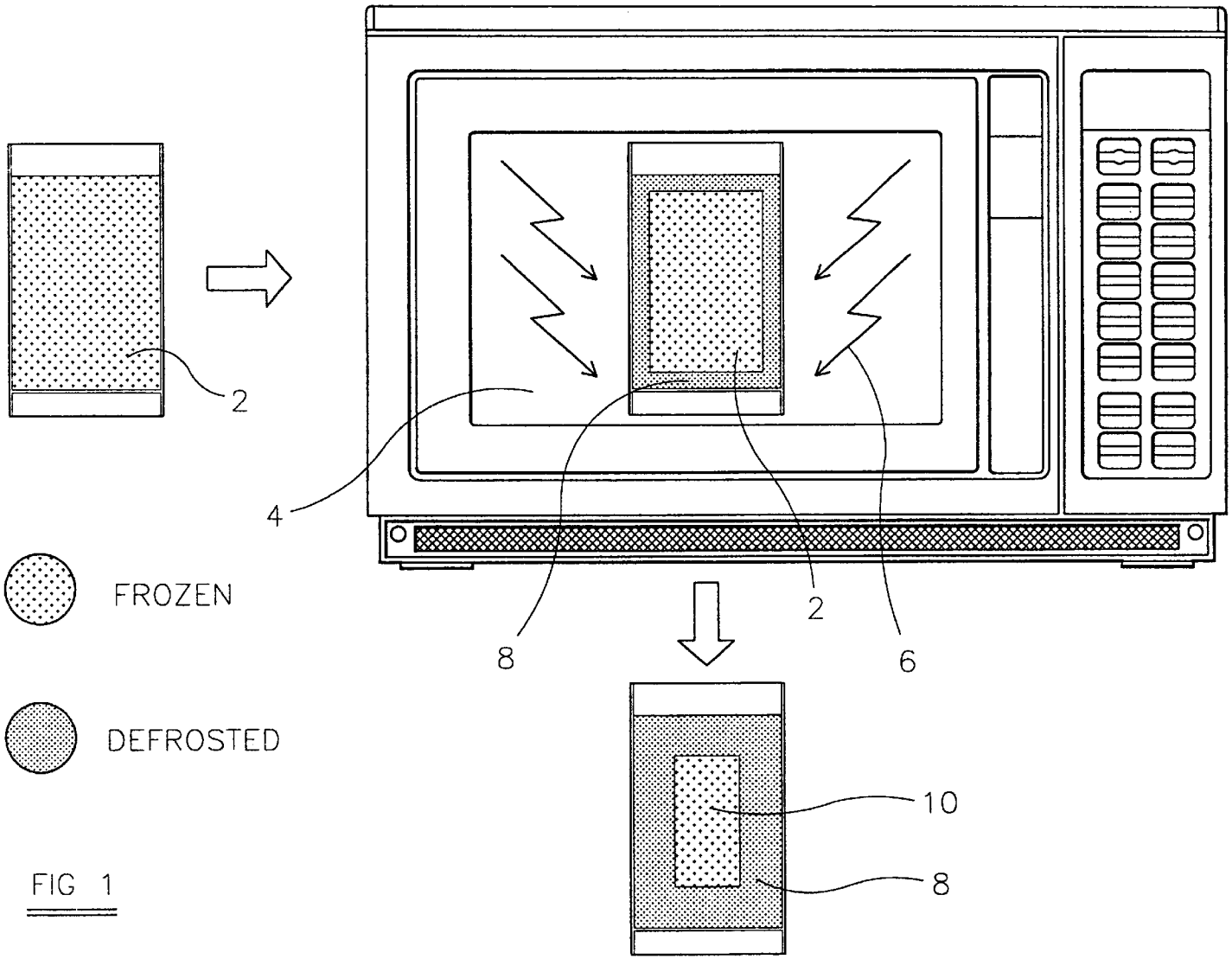
FIG. 1 shows a conventional microwave oven, and illustrates the effect of heating a frozen product in such an oven.

FIG. 1 shows the usual method of heating a product 2 in a microwave oven 4. The product 2 is placed in the microwave oven 4 and the oven 4 switched on. The microwaves 6 penetrate the outer surface 8 of the product 2, causing a localised increase in temperature. As the local temperature rises, the absorption of microwaves by the outer region of the product 2 increases, leading to a "runaway" effect where only the warmer regions in the product 2 increase in temperature. This leads to surface melting, while the inner parts 10 of the product 2 remain substantially "deep frozen".

Figure 2:
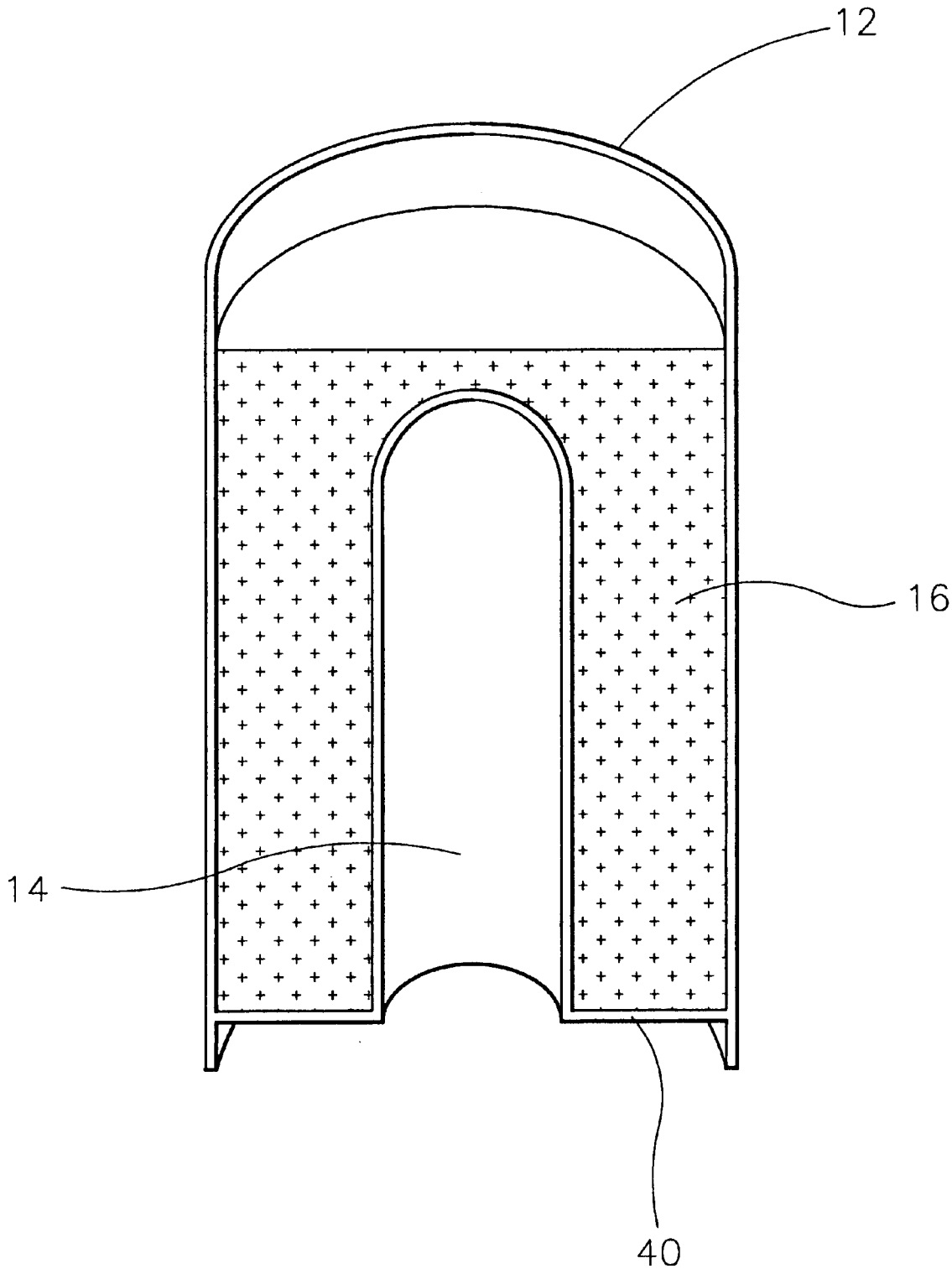
FIG. 2 shows a container used in a known method of attempting to overcome the problem of thawing at the edge of a product.

FIG. 2 shows a container 12 with a central hollow tube 14, which thereby reduces the thickness of the product 16 required to be heated. However, because of the small diameter of this tube 14, no appreciable amount of microwaves can penetrate inside the tube, so the amount of heating from inside the tube is minimal. If the central tube is made larger, as mentioned above, products can become very bulky and inconvenient to store whilst frozen.

Figure 3:
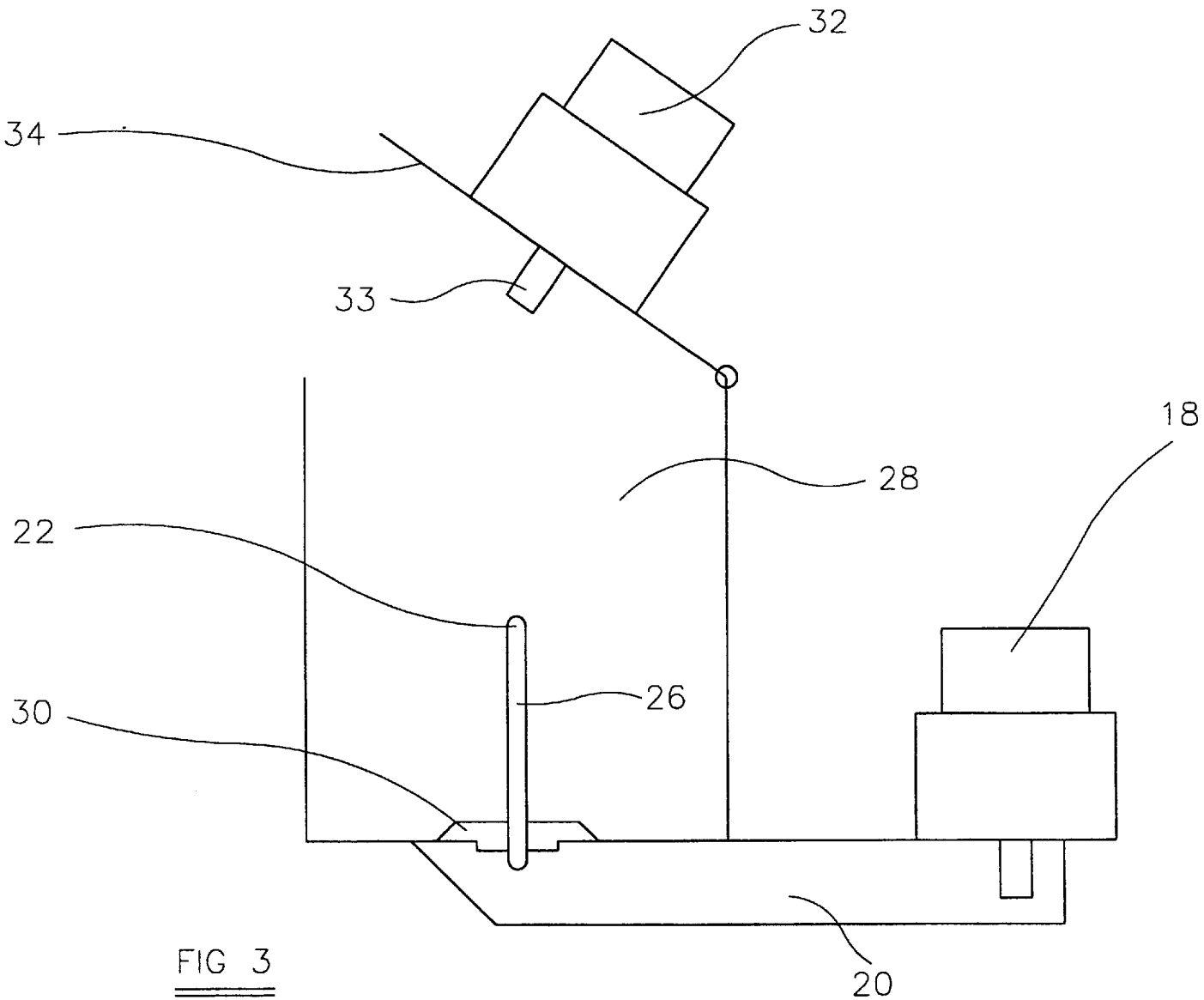
FIG. 3 shows a microwave heating apparatus in accordance with an embodiment of the present invention.

An embodiment of the present invention is shown in FIG. 3. This comprises a magnetron 18, which is coupled via a waveguide 20 to a tuned antenna 22, a lower part of which is within the waveguide and acts as a pick-up for the microwave energy, and an upper part 26 of which is within a tempering cavity 28 and acts as a re-radiator of the microwave energy. In one embodiment this cavity 28 is of substantially cylindrical form, but it may be any convenient shape. The magnetron will typically emit microwaves of frequency 2.45 GHz. It should be appreciated that any suitable microwave source may be used instead of a magnetron, including a solid state microwave source.

The product (not shown in FIG. 3) is placed into the cavity 28 in a container 12 similar to that shown in FIG. 2, having a central hollow tube 14 extending upwards from its base 40. The tuned antenna 22 is arranged in such a way that, when the product, in its container, is placed in the tempering chamber, the re-radiating section 26 of the antenna 22 protrudes into the central hollow tube 14 of the product to be heated. The antenna 22 is located centrally in an opening in the waveguide 20 by means of an insulating component 30 made from a material which has a low dielectric constant at microwave frequencies, such as a ceramic, or PTFE, or polypropylene. An additional magnetron 32, which is conventional in its application, also supplies microwaves to the cavity 28, and is attached in the present embodiment to the cavity door 34, in order to heat the product from the outside. Magnetron 32 is provided with antenna 33. It is important to note that the magnetrons 18 and 32 are independently controllable, as will be described below.

Figure 4:
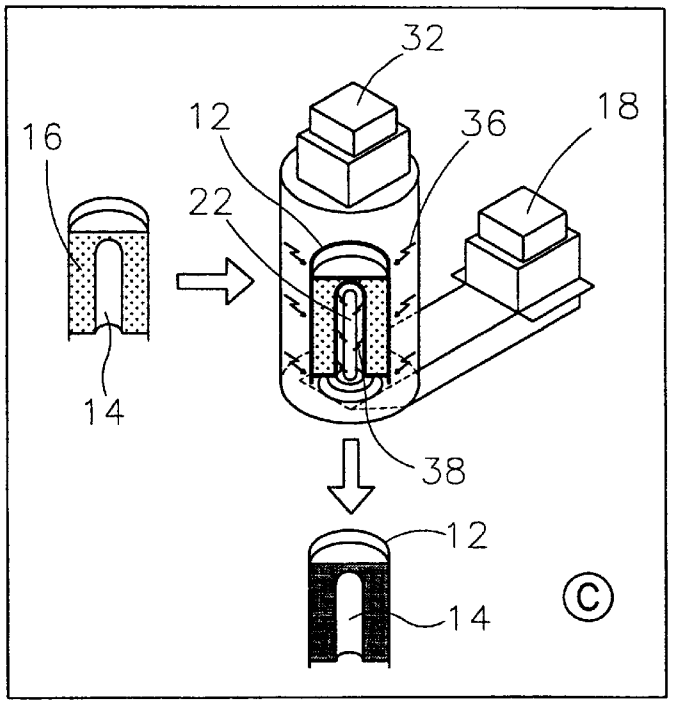
FIG. 4 shows four stages in a process for defrosting a frozen article according to a preferred embodiment of the present invention.
Figure 4:
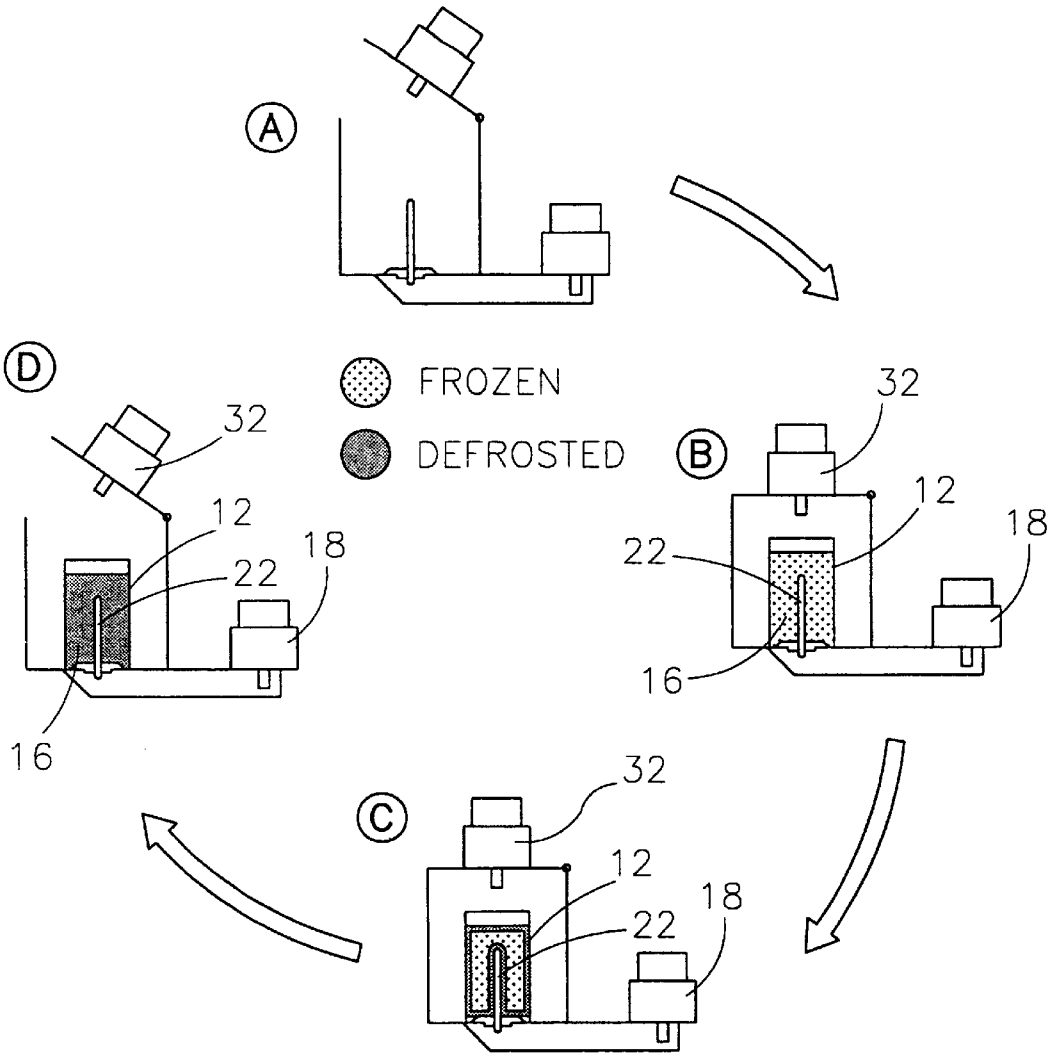

FIG. 4 shows four stages (A, B, C and D) in the operational sequence of the embodiment shown in FIG. 3. At stage (A) the cavity 28 is empty. At stage (B) the frozen product 16 in its container 12 is placed into the tempering cavity 28, and the cavity door 34 is closed. The antenna 22 protrudes into the central hollow tube 14 of the container. When the system is switched on, at stage (C), microwaves 36 and 38 are emitted from the source 32 and antenna 22 respectively. This means that the product is irradiated by microwaves from inside the hollow tube 14 and from the outside at the same time. Although the surface will still thaw, the surface area irradiated by microwaves is greatly increased compared to the example shown in FIG. 1, and the thickness of product between the thawed surfaces is greatly decreased. At stage (D) the product has been evenly defrosted.

At this stage it would be possible to apply additional microwave heating to the food product to increase the temperature to a suitable temperature for serving, i.e. soup or a similar product could therefore be taken from "Deep frozen" to serving temperature in one continuous operation. The apparatus described may be used in conjunction with conventional heating means, for example hot air or infrared heating, to meet a specific need such as raising the surface temperature to cause cosmetic browning.

Figure 5:
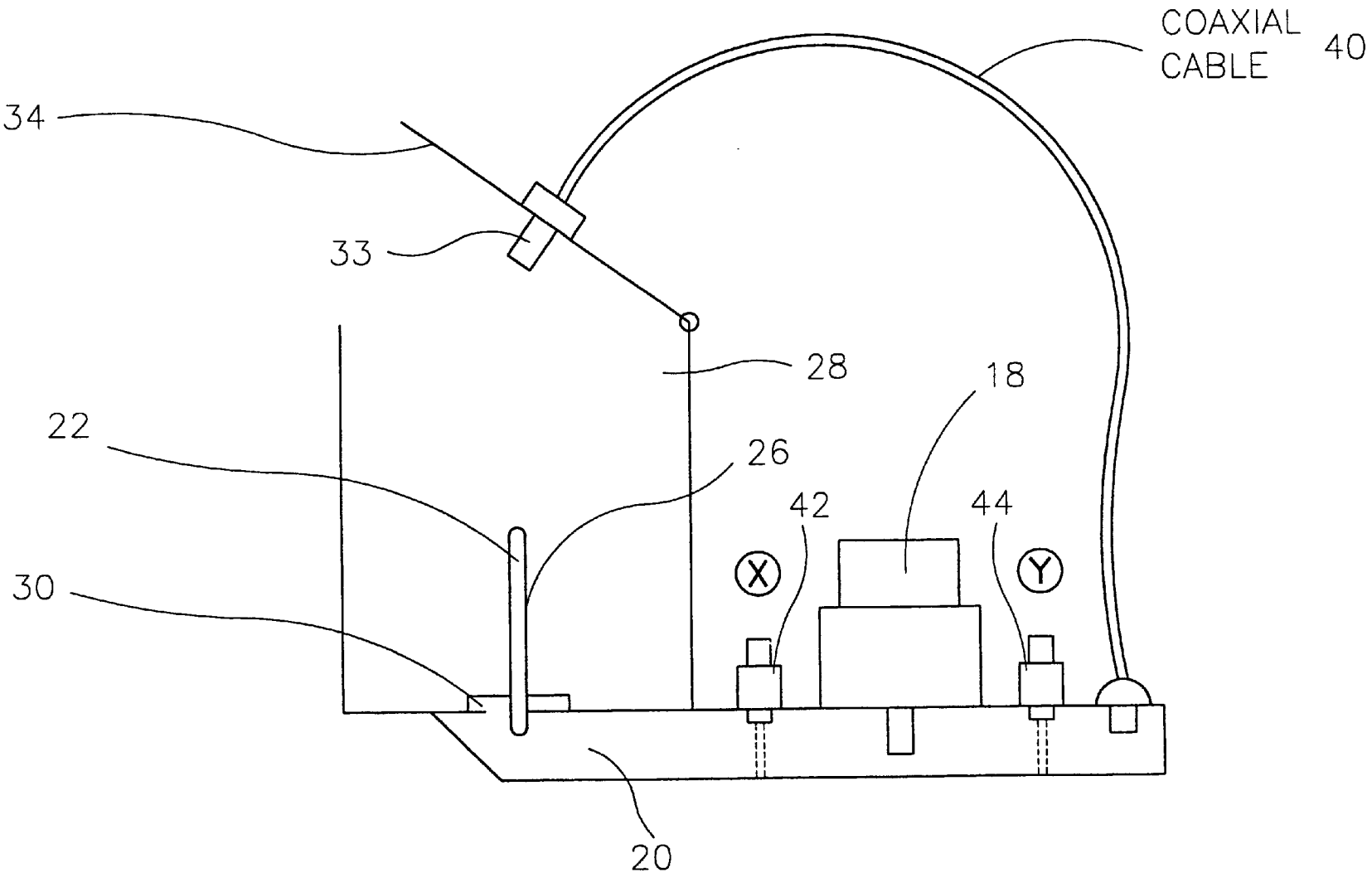
FIG. 5 shows a second embodiment of a microwave heating apparatus in accordance wit h the invention.

FIG. 5 shows an alternative embodiment in which the antenna 22 and antenna 33 are both supplied by magnetron 18. The same reference numerals are used for parts which correspond with FIG. 3. Antenna 33 is connected to waveguide 20 by a coaxial cable 40. The magnetron 18 is positioned on waveguide 20 between two adjustable waveguide shutters 42 and 44. Shutter 42 controls the supply of microwave energy to antenna 22, and shutter 44 controls the supply of microwave energy to antenna 33. The shutters 42 and 44 can be controlled either manually, or electrically.

U.S. Pat. Nos. 5,451,751, 4,449,026 and 3,697,894 describe other means for determining the direction of the microwave energy.

Figure 6:
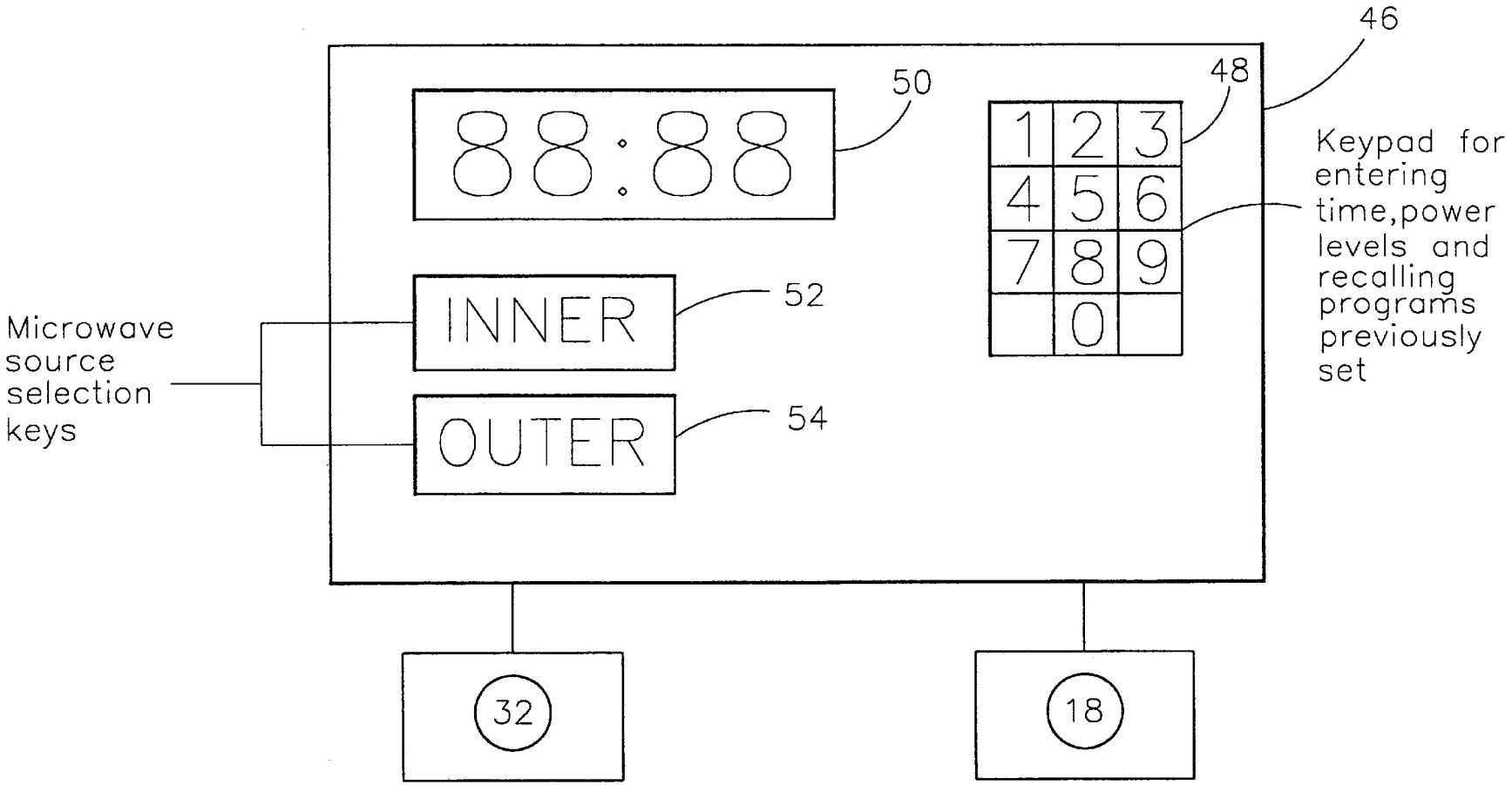
FIG. 6 shows a control panel for controlling the embodiment of FIG. 3, or FIG. 5.

FIG. 6 shows a suitable control panel 46 for allowing a user to independently control the two magnetrons 18 and 32 shown in the embodiment of FIG. 3. The control panel 46 is provided with a keypad 48, a visual display 50, and separate "INNER" and "OUTER" buttons 52 and 54 for allowing independent control of magnetrons 18 and 32 respectively. The user can thus control the rates at which the food is heated both internally and externally, and the microwave oven may also be provided with suitable preset programmes providing different levels of internal and external heating for different types, sizes and shapes of food. The control panel 46 is also suitable for controlling the embodiment of FIG. 5. In this case, the INNER button 52 controls shutter 42, and the OUTER button 52 controls shutter 44.

Figure 7:
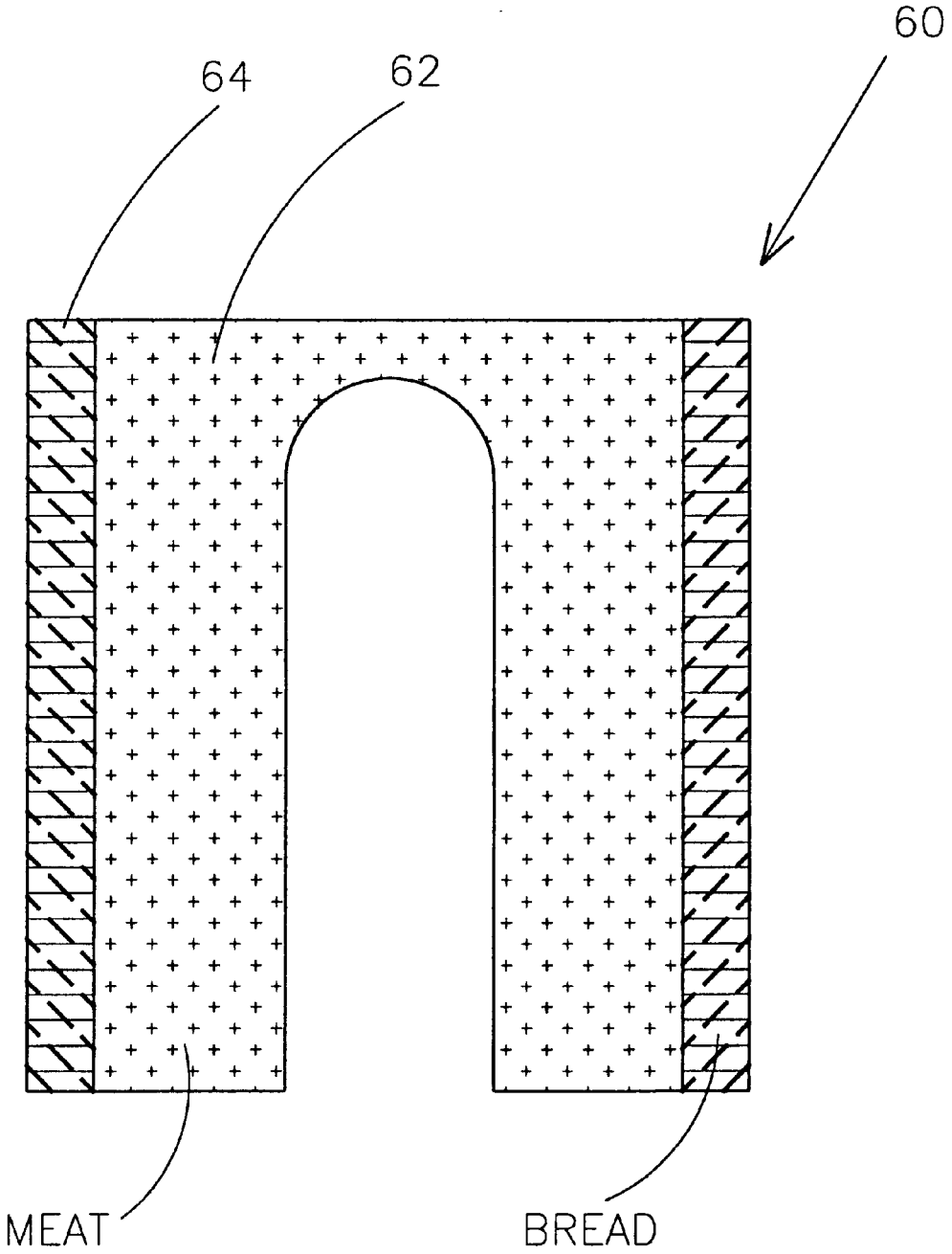
FIG. 7 shows a combination food product suitable for heating using the embodiment of FIG. 3, or FIG. 5.

FIG. 7 shows an example of a combination food product 60 comprising a layered construction of two food types with different dielectric properties. The example shown in FIG. 7 is that of a filled bread roll comprising a meat inner layer 62 and a bread outer layer 64. In this case, more microwave energy is required to be supplied from inside the product than from the outside. However, it should be appreciated that even in the case of a homogeneous food product it may be necessary to vary the relative power levels of the internal and external sources in order to ensure an even temperature distribution throughout the food product.

It will be appreciated that there are other possibilities for working the invention. For example, the antenna need not be coupled to the microwave source via a waveguide; microwaves could be supplied via a coaxial cable. The preferred embodiment shows the antenna 22 permanently attached to the cavity, but it may be removable therefrom.

It will also be appreciated that the invention is suitable for use with many different shapes of container. For example, the cylindrical container 12 shown in FIG. 2 may be replaced by a frustroconical container.

What is claimed is:

1. A microwave heating apparatus comprising:

a cavity for heating food;

a first antenna, which projects into the cavity and is arranged to pass into or through said food, in use, in order to irradiate said food internally;

a second antenna arranged to supply microwave radiation into said cavity in order to irradiate said food externally;

at least one microwave source for supplying microwave energy to the first and second antennae; and control means for allowing a user to independently control the levels of microwave energy irradiated by the first and second antennae.

2. A microwave heating apparatus as claimed in claim 1, wherein first and second microwave sources are provided for supplying microwave energy to the first and second antennae respectively, and wherein said control means allows independent control of the first and second microwave sources.

3. A microwave heating apparatus as claimed in claim 1, wherein a microwave source supplies microwave energy to both the first and second antennae, and wherein said control means controls how the energy from the microwave source is split between the first and second antennae.

4. A microwave heating apparatus as claimed in claim 1, wherein said control means comprises two waveguide shutters.

5. A microwave heating apparatus as claimed in claim 1, wherein the first antenna also projects outside of the cavity.

6. A microwave heating apparatus as claimed in claim 1, wherein microwave energy is supplied to the first antenna at a location outside of the cavity.

7. A microwave heating apparatus as claimed in claim 1, further comprising a non-microwave heating means for heating said food within the cavity.

8. A microwave heating apparatus as claimed in claim 7, wherein the non-microwave heating means includes the use of hot air.

9. A microwave heating apparatus as claimed in claim 7, wherein the non-microwave heating means includes the use of infra-red heating.

10. A microwave heating apparatus as claimed in any claim 1, wherein said control means allows the energy emitted by the first and second antennae to be adjusted over a range of values.

11. A microwave heating assembly comprising a microwave heating apparatus as claimed in claim 1, and a container having an aperture arranged to receive the first antenna.

12. A microwave heating apparatus comprising:

a cavity for heating food;

a first antenna, which projects into the cavity and is arranged to pass into or through said food, in use, in order to irradiate said food internally;

a second antenna arranged to supply microwave radiation into said cavity in order to irradiate said food externally;

at least one microwave source for supplying microwave energy to the first and second antennae; and a controller for allowing a user to independently controls the levels of energy irradiated by the first and second antennae.

13. A method for heating food comprising:

providing a microwave heating apparatus including a cavity for heating food, a first antenna, which projects into the cavity and is arranged to pass into or through said food, in use, in order to irradiate said food internally, a second antenna arranged to supply microwave radiation into said cavity in order to irradiate said food externally, at least one microwave source for supplying microwave energy to the first and second antennae, and a controller for allowing a user to independently controls the levels of energy irradiated by the first and second antennae;

placing food within said cavity so that the first antenna passes into or through the food; and irradiating the food internally using the first antenna and externally using the second antenna.

* * * * *